US005740949A

United States Patent [19]

Park

[11] Patent Number: 5,740,949

[45] Date of Patent: Apr. 21, 1998

[54] AIR PUMP FOR NATURAL MINERAL WATER BARREL

[76] Inventor: Kyoung-Seo Park, Lucky Apt. 1-602, 1257, Kuro6-dong, Kuro-ku, Seoul, Rep. of Korea

[21] Appl. No.: 650,572

[22] Filed: May 20, 1996

[51] Int. Cl.[6] ..... B65D 37/00

[52] U.S. Cl. ..... 222/209; 222/400.8; 222/401

[58] Field of Search ..... 222/400.8, 401, 222/209; 137/212; 417/118, 472

[56] References Cited

U.S. PATENT DOCUMENTS 1,460,208 6/1923 Mohn ..... 22/400.8 X 4,436,227 3/1984 Johnson, Jr. et al. ..... 222/400.8 X 5,197,866 3/1993 Kim ..... 417/472

*Primary Examiner*—Gregory L. Huson

*Attorney, Agent, or Firm*—Seed and Berry LLP

[57] ABSTRACT

An air pump for a natural mineral water barrel includes a cover member, a bellows and a sealing means. The pump can dispense natural mineral water without inclining the barrel for consumption and improve the sealing capacity regardless of changing the diameter of the barrel due to the replacement of the barrel. Further, the supply of water can be freely adjusted at user's option regardless of the change of the entire length of the barrel.

17 Claims, 7 Drawing Sheets

AIR PUMP FOR NATURAL MINERAL WATER BARREL

BACKGROUND OF THE INVENTION

1. Field of the Invention

The present invention relates to an air pump for a natural mineral water barrel for dispensing natural mineral water, without the barrel being inclined.

2. Description of the Prior Art

As is well known, water barrels installed in home and offices are stood upside down and are fixedly mounted by a separate supporting means with a button-type valve mounted into the mouth of the barrel so that the water is drained by pressing the valve.

However, such an arrangement occupies unnecessary space and incurs the wasteful expense of installation due to the use of separate supporting means. Also, mounting the water barrel in the upside down position does not provide a sense of security since it can be considered unstable by its users.

In order to overcome these defects, it is proposed that an air pump for use in a natural mineral water barrel needs not to be inclined at an angle to be pour the mineral water into a glass.

The pump is divided into an automatic air pump and a manual air pump according to an operating manner.

In the manual air pump, when users push downward on a press member of the air pump coupled to a water barrel, a bellow is compressed to thereby to inject air into the barrel, increasing a pressure in the barrel. At this time, users can pour the mineral water discharged through an outlet pipe into a glass or a cup.

If the injected air pressure into the barrel is reduced from leakage due to the unsealing, the pumping power is reduced, thereby decreasing the discharge of the mineral water. Accordingly, a seal between an air pump fitted in the mouth of the barrel and the barrel is a most important matter in the manual air pump.

U.S. Pat. No. 5,197,866 discloses a sealing structure between an air pump and a mineral water barrel, in which a stopper having a sealing cap is covered on the outer periphery surface of the barrel, the lower portion of the stopper being broader than the upper portion thereof, and a nut attached to the outer side of the stopper rotates, thereby tightening the sealing cap on the neck of the barrel.

However, when the sealing cap, made of a soft rubber, is compressed against the neck of the barrel by applying a pressure in tightening the stopper, if the outer diameter of the barrel is sightly smaller than that of the sealing cap, the sealing cap is not adhered closely to the neck of the barrel and is wrinkled. As a result, it is impossible to seal the neck of the barrel in operating an air pump, occurring a leakage of an air pressure through an air passage formed between the wrinkles. That is, as it is impossible to maintain the constant sealing capacity regardless of changing the diameter of the barrel due to the replace of the barrel, the pumping power of the air pump is decreased. Further, the prior air pump sealing device needs many parts, such as a sealing cap adhered closely to the mouth of the barrel, a stopper and a nut for tightening the cap as well as the stopper should be provided with a plurality of cutout grooves and threaded portions, to which the nut for tightening is integrally mounted, causing the structure of the air pump to become more complicated, rendering it difficult to manufacture, increasing the cost manufacturing thereof and lowering the operation efficiency thereof.

SUMMARY OF THE INVENTION

Accordingly, it is an object of the invention to provide an air pump for a natural mineral water barrel, which is used in an erect position, to thereby give a user sense of stability, and eliminate inconvenience in upside down installation of the barrel.

It is another object of the invention to provide an air pump for a natural mineral water barrel, whose inlet is sealed up regardless of change of diameters of barrel neck due to the replacement of various types of mineral water barrels, to thereby sharply enhance the airtightness maintaining performance.

It is still another object of the invention to provide an air pump for a natural mineral water barrel in which even water placed on the bottom can be lifted up to thereby fully consume the water, regardless of the entire length of various types of barrels.

It is yet another object of the invention to provide an air pump for a natural mineral water barrel, in which the amount of mineral water is freely controlled by a user when mineral water is discharged.

To achieve the forgoing objects, the present invention provides an air pump for a natural mineral water barrel comprising:

a cover member comprising an upper cover including a through-hole whose radius center is eccentrically positioned from a radius center of a cylindrical body, an annular flange being extended downward on the inner periphery of said through-hole, a guide piece being formed lengthwise from said upper cover on one side of the inner periphery thereof, and fixed protrusions being formed at a predetermined interval along the circumference of said upper cover in the lower portion thereof, a lower cover including fixed holes formed in the outer periphery of the upper portion thereof so as to correspond to the fixed protrusion, a circular boss projected downward from the lower center of the lower cover by a predetermined distance, an air injecting pipe having threaded portions with a predetermined length, respectively, in the upper and lower of the outer periphery thereof and projected from the lower center of the circular boss, and a drain pipe formed within the air injecting pipe at a predetermined interval from the inner periphery of the air injecting pipe and passed through and extended from a side wall of the outer periphery of the lower cover, a head having a circular shaped flange formed in the lower outer periphery thereof and formed eccentrically from the center of thereof, said head being disposed inside of an upper cover so as to be inserted into or projected from the inside of the upper cover;

a bellows including an upper boss disposed to the upper center portion thereof which is provided with a pressure spring and a lower boss disposed to the lower center portion thereof, the upper and lower bosses corresponding to a mounting groove of an operation plate having a suction valve and a mounting groove formed in the center portion of the lower cover, respectively; and a sealing means including a packing tube inserted through the outer periphery of the air injecting pipe, said air injecting pipe being joined with a seperation preventing cap at a lower portion thereof, and a pressing means for pressing the packing tube so as to be expanded radially, whereby the packing tube makes a tight contact with a periphery of a neck of the barrel for sealing the barrel from outside.

The pressing means includes a first threaded portion formed on the periphery of the air injecting pipe, and a second threaded portion formed on an inner periphery of a fastening nut for engagement with the first threaded portion, whereby rotation of the fastening nut forces the air injecting pump to move in an selected axial direction to compress the packing tube. The air pump further comprises a sliding plate mounted into the bottom surface of the second threaded portion of the fastening nut so as to prevent a friction therebetween.

The fastening nut is provided with a plurality of grip grooves on the outer periphery of the tubular portion thereof so as to allow users to easily tighten and loosen the fastening nut.

The upper surface of the sliding plate is provided with a plurality of annular sliding protrusions so as to reduce the friction between the bottom surface of the second threaded portion of the fastening nut and the sliding plate.

The air pump further comprises a suction pipe connected to the drain pipe of the lower cover, an extension pipe connected to the suction pipe, and a connecting member having a flexibility and a elasticity and disposed to the connecting portion between the suction pipe and the extension pipe so as to allow the extension pipe to come utmost close to the bottom of the barrel regardless of the entire length of the barrel.

The air pump further comprises a banded guide pipe connected to the drain pipe so as to guide the discharge of the water, and a plug member disposed on the guide pipe so as to be able to cover the entrance of the guide pipe except when dispensing water.

The air injecting pipe is provided with non-threaded area between the screw threads formed on the upper and lower portions of the air injecting pipe to idle the fastening nut, when the fasten nut is lifted down past the upper screw thread, thereby preventing the packing tube from excessively expanding.

The flange of the head is provided with a guide groove on the outer periphery thereof, thereby corresponding to the guide piece on the inner periphery of the upper cover and guiding the axial rectilinear motion of the head.

The screw thread of the threaded portions of the air injecting pipe has a trapezium sectional shape or a trapezoid sectional shape.

The separation preventing cap is provided with a circular protrusion on the both sides thereof, the protrusion having a screw fastening hole for improving the engaging force between the air injecting pipe and the cap.

The separation preventing cap is provided with a locking protrusion on the both sides thereof so as to allow the cap to be easily loosen.

The connecting member is made of silicone resin.

The plug member has a cap shape or a wedge shape.

BRIEF DESCRIPTION OF THE DRAWINGS

The above and other objects, features and advantages of the present invention will become apparent from the following detailed description of preferred embodiments taken in conjunction with the accompanying drawings, in which.

DETAILED DESCRIPTION OF THE PREFERRED EMBODIMENTS

Figure 1:
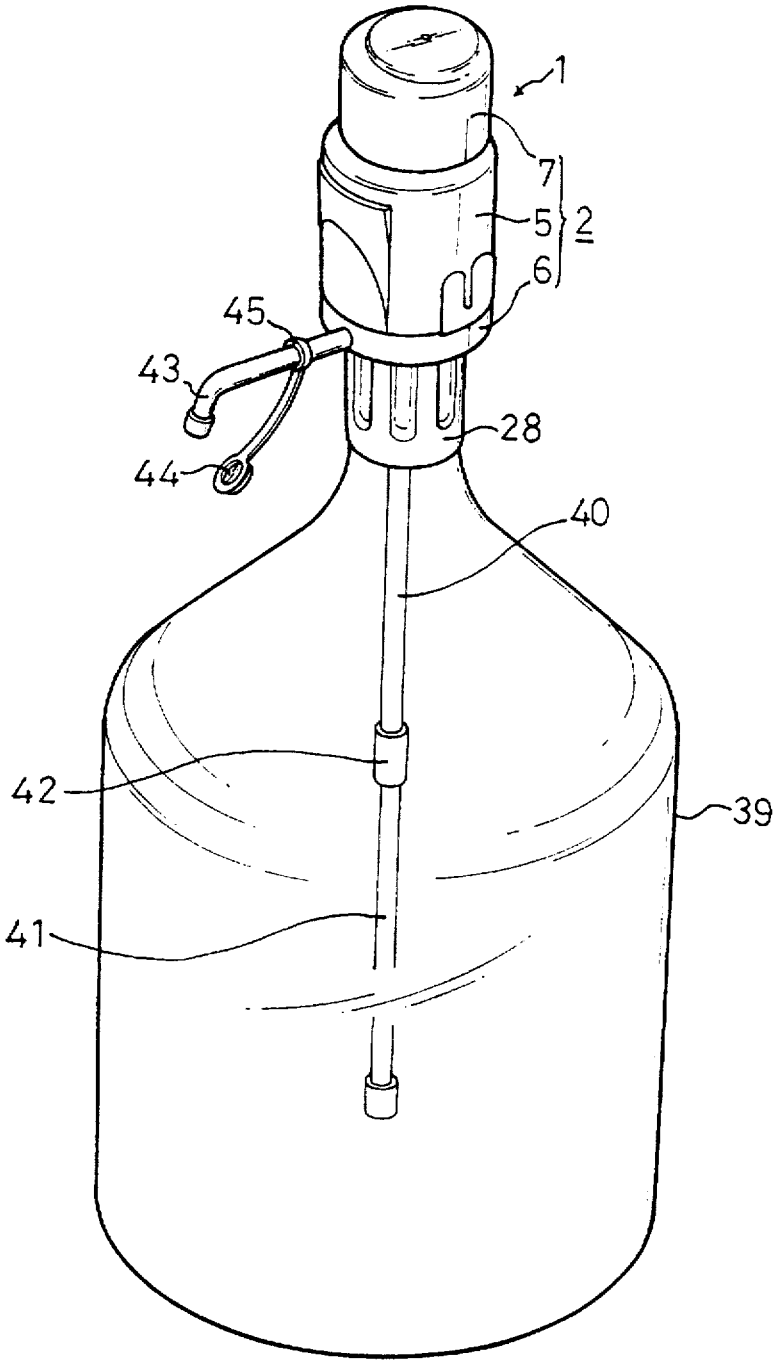
FIG. 1 is a perspective view of an air pump of the invention installed in a mineral water barrel.
Figure 2:
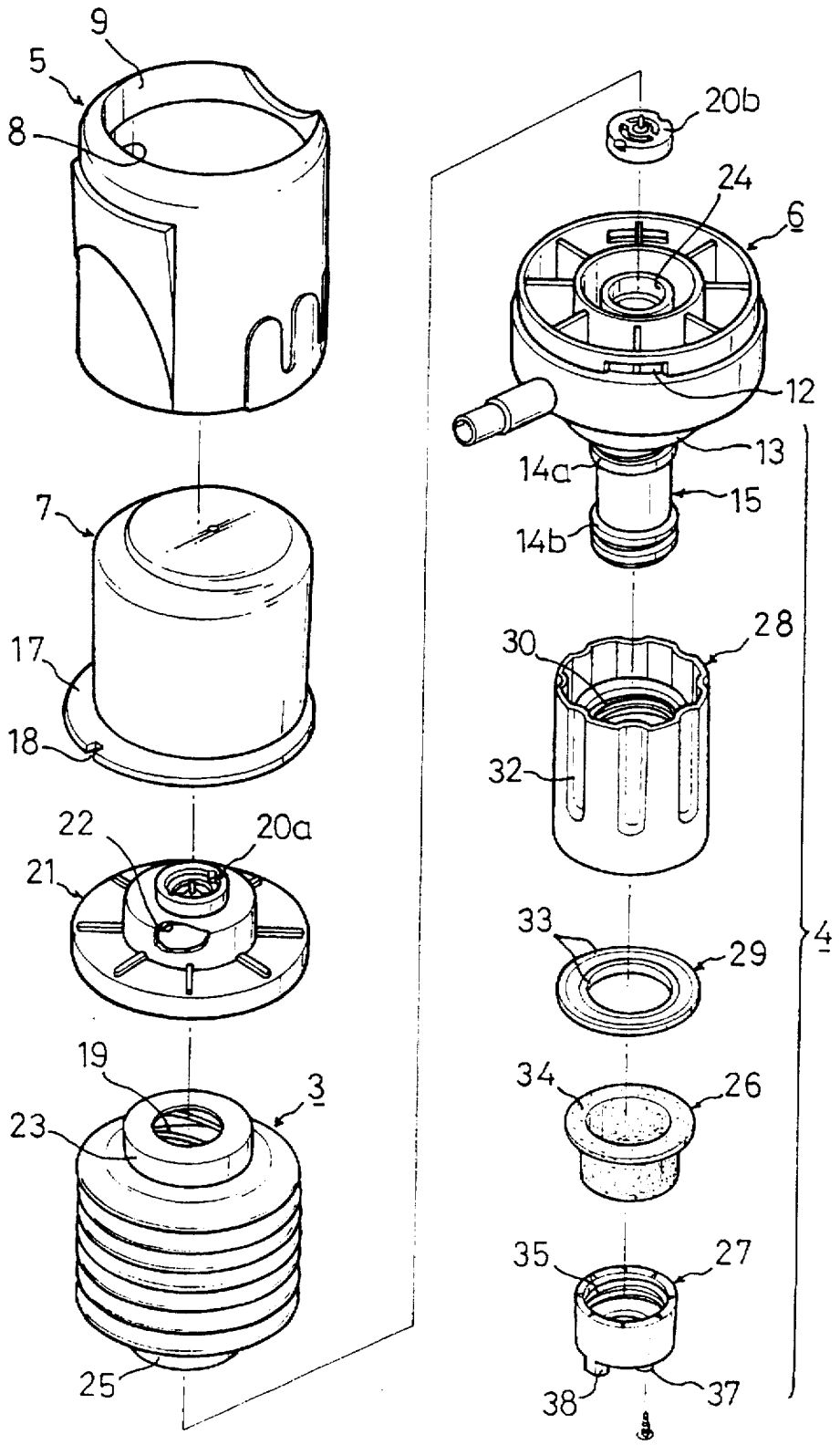
FIG. 2 is an exploded perspective view of the air pump of the invention.
Figure 3A:
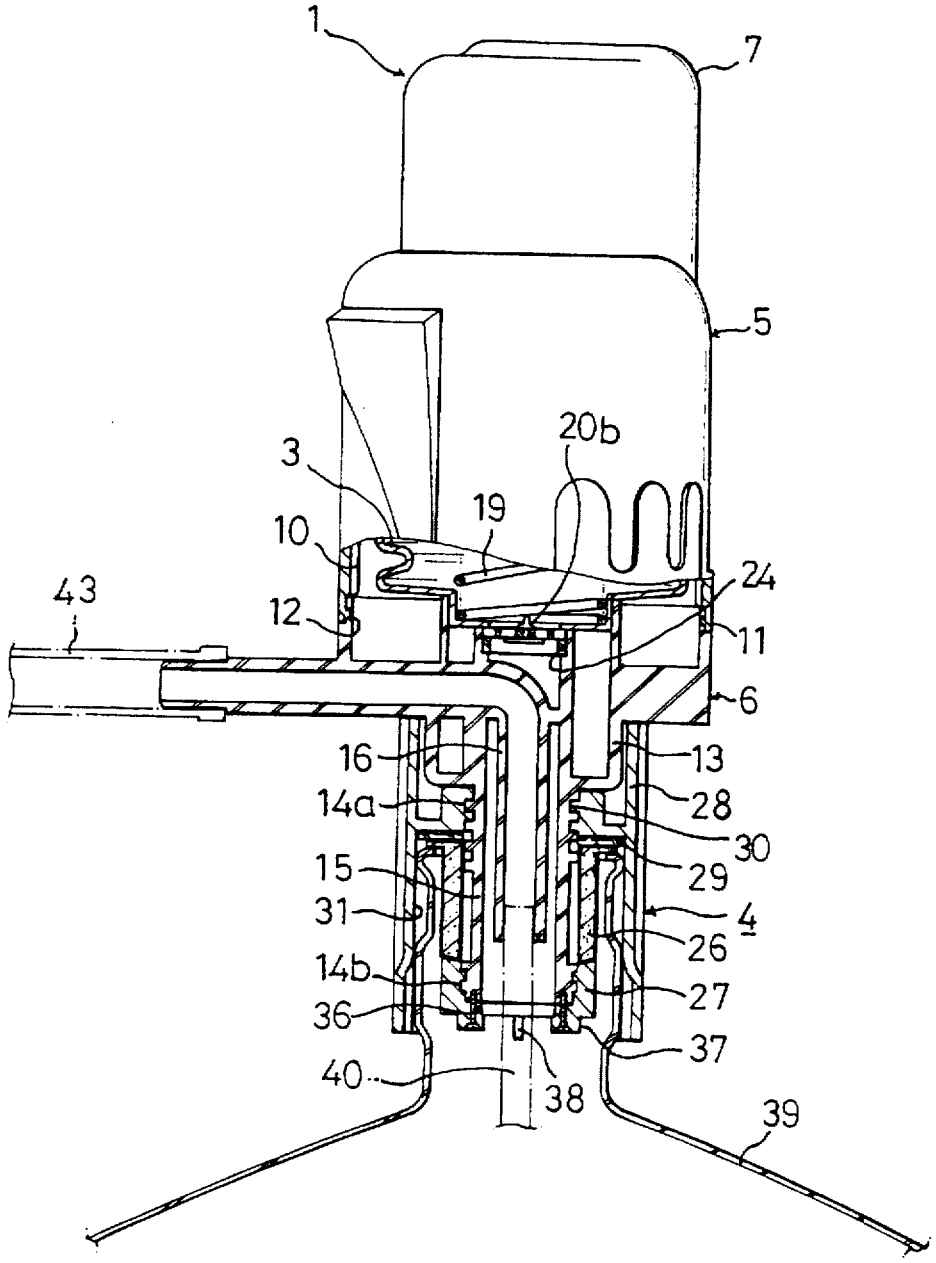
FIG. 3A is a vertical sectional view in which a packing tube of the air pump of the present invention does not close the inlet of the barrel.
Figure 3B:
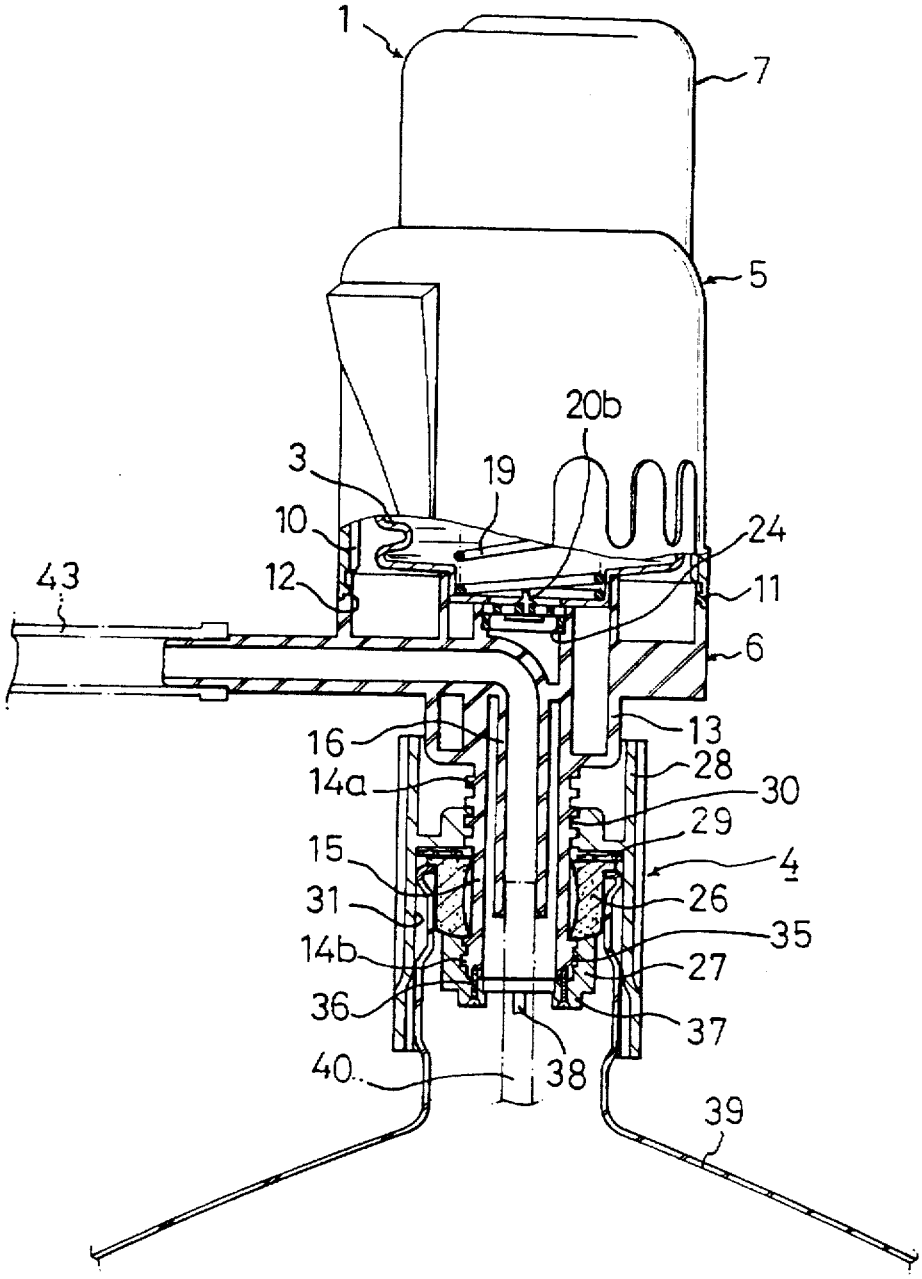
FIG. 3B is a vertical sectional view in which the packing tube of the air pump is expanded to thereby close the inlet of the barrel.
Figure 4:
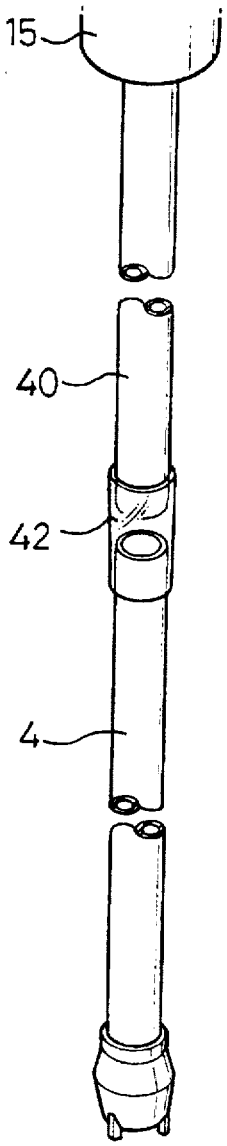
FIG. 4 is a perspective view of a suction pipe of the air pump in accordance with the invention.
Figure 5:
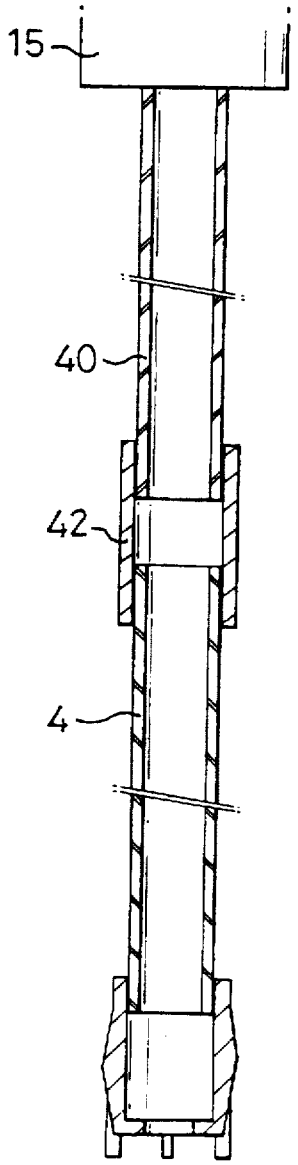
FIG. 5 is a vertical sectional view of FIG. 4.

Referring now to FIGS. 1 to 6, there is shown an air pump for a natural mineral water barrel in accordance with a preferred embodiment of the invention. The air pump comprises a cover member 2, a collapsible bellows 3 and a sealing member 4.

The cover member 2 includes an upper cover 5, a lower cover 6 and a head 7.

The upper cover 5 includes a through-hole 8, the radius center of the through-hole being eccentrically positioned from a radius center of a body having a cylindrical shape by a predetermined distance, an annular flange 9 extended downward at the inner periphery of the through-hole 8, a guide piece 10 formed along a longitudinal direction of the upper cover 5 in the side of the inner periphery thereof, and a fixed protrusion 11 formed at predetermined interval along the circumference of the upper cover 5 in the lower portion thereof.

The lower cover 6 includes a fixed hole 12 formed in the outer periphery of the upper portion thereof so as to correspond to the fixed protrusion 11, respectively, a circular boss 13 projected downward from the lower center of the lower cover 6 by a predetermined distance, and an air injecting pipe 15 having threaded portions 14*a* and 14*b* with a predetermined length, respectively, in the upper and lower of the outer periphery thereof and projected from the lower center of the circular boss 13. At this time, the screw thread of the threaded portions 14*a* and 14*b* of the air injecting pipe 15 has a trapezium sectional shape or a trapezoid sectional shape. Further, a drain pipe 16 formed within the air injecting pipe 15 at a predetermined interval form the inner periphery of the air injecting pipe 15 and passed through and extended from a side wall of the outer periphery of the lower cover 6.

A flange 17 having a circular shape, the center thereof being eccentrically provided from the center of the head 7. The flange 17 of the head 7 is provided with a guide groove 18 on the outer periphery thereof, thereby corresponding to the guide piece 10 on the inner periphery of the upper cover 5 and guiding the axial rectilinear motion of the head.

A bellows 3 includes an upper boss 23 disposed to the upper center portion thereof which is provided with a pressure spring 19 and a lower boss 25 disposed to the lower center portion thereof, the upper and lower bosses corresponding to a mounting groove 22 of an operation plate having a suction valve 20*a* and a mounting groove 24 formed in the center portion of the lower cover 6, respectively.

Accordingly, The cover member 2 and the bellows 3 are assembled as follow:

The upper boss 23 formed on the upper portion of the bellows 3 is placed in the mounting groove 22 of the operating plate 21 and then is compressed. Then, as the bellows 3 is made of a soft material, the upper boss 23 is closely fitted to the mounting groove 22 of the operating plate.

In the assembled condition as stated above, the lower boss 25 of the bellows 3 is placed in the mounting groove 24 of the center of the lower cover 6 and then is compressed, assembling the bellows 3 with the lower cover 6.

On the other hand, the head 7 is inserted into the upper cover 5 so as to allow the guide piece 10 formed along the axial direction of the inner periphery of the upper cover 5 to correspond to the guide groove 18 formed on the flange 17 of the head 7, thereby being inserted into or projected from the inside of the upper cover 6.

Hereinafter, in the projected state of the head 7 from the upper cover 5, the head 7 covers the bellows 3 and the upper and lower covers 5 and 6 are assembled together so as to allow the fixed protrusion 11 of the upper cover 5 to mount to the fixed hole 12 of the lower cover 6.

In this condition, when force is exerted from both directions of the upper and lower covers 5 and 6, the fixed protrusion 11 formed on the lower inner periphery of the upper cover 5 has an elasticity and is mounted past the upper jaw of the fixed hole 12 formed on the upper periphery of the lower cover 6 within the fixed hole 12, thereby integrally forming the upper and lower covers 5 and 6.

On the other hand, the sealing member 4 includes a elastic packing tube 26, a separation preventing cap 27, a fastening nut 28 which is pressing means for the packing tube 28, and a sliding plate 29.

The packing tube 26 has a cylindrical shape and is provided with a flange 34 on the upper portion thereof which is contacted to the bottom surface of the sliding plate 29.

The separation preventing cap 27 is provided with a threaded portion 35 is formed on the inner periphery portion thereof so as to be engaged with the threaded portion **14*b* of the air injecting pipe 15, a circular protrusion 37 on both sides thereof, the protrusion having a screw fastening hole 36 for improving the engaging force between the air injecting pipe 15 and the cap 27, and a locking protrusion 38 to the both sides thereof so as to allow the cap 27** to be easily loosen.

The fastening nut 28 which is pressing means for packing tube 28, includes a threaded portion 30 formed on the inner periphery thereof, the threaded portion 30 being engaged with the threaded portions **14*a* and 14*b* of the air injecting pipe 15 of the lower cover 6, and a tubular portion 31 radially extended from the threaded portion 30 and extended toward the upper and lower portions perpendicular to the threaded portion 30, thereby wrapping the circular boss 13 of the lower portion of the lower cover 6 and the air injecting pipe 15. Further, the fastening nut 28 is provided with a plurality of grip grooves 32 on the outer periphery of the tubular portion 31** thereof so as to allow users to easily tighten and the fastening nut loosen.

The sliding plate 29 has an annular sliding portion 33 on the upper side thereof and is in the form of a planar surface on the lower side thereof.

Accordingly, after completing the assembling of the upper cover 2 and the bellow 3 as described above, the sealing member 4 is locked into the threaded portions **14*a* and 14*b* of the air injecting pipe 15 by means of the fastening nut 28**.

The tubular portion 31 of the fastening nut 28 wraps the circular boss 13 and is tighten so the upper portion of the tubular portion is closely attached to the lower surface of the lower cover 6.

Next, the cover member 2 turns out and then the annular sliding portion 33 of the sliding plate 29 is inserted toward the head 7. The packing tube 26 fits into the periphery of the cylindrical air injecting pipe 15.

Then the separate preventing cap 27 is locked onto the threaded portion **14*b* of the air injecting pipe 15, which projects from the upper portion of the packing tube 26**.

As state above, in case of locking the separate preventing cap 27 into the lower portion of the cylindrical air injecting pipe 15, the separate preventing cap 27 is easily tighten by means of the locking protrusions 38 which are facing each other on both sides of the lower portion of the cap 27.

That is, when each of the locking protrusions 38 is subjected to the force acting in the opposite direction; respectively, a rotating moment is exerted on the separation preventing cap 27 to thereby to secure it to the screw portion **14*b* of the air preventing pipe 15**.

Further, the circular protrusion 37 of the separation preventing cap 27 is provided with a screw locking hole 36 to thereby increase the locking force of the air injecting pipe 15 and the separate preventing cap 27 by fastening a screw in the hole 36.

On the other hand, a connecting member 42, made of silicone resin, having a flexibility and a elasticity is disposed to the connecting portion between a suction pipe 40 connected to the drain pipe 16 of the lower cover 6 and an extension pipe 41 connected to the suction pipe 40 so as to allow the extension pipe 41 to come utmost close to the bottom of the barrel regardless of the entire length of the barrel.

A banded guide pipe 43 is connected to the drain pipe 16 so as to guide the discharge of the water, and a plug member 44 is disposed through a connecting ring 45 on the guide pipe 43 so as to be able to cover the entrance of the guide pipe 43 except when dispensing water. The plug member 44 has a cap shape or a wedge shape.

In case of installing the inventive air pump as described above to a barrel 39, the fastening nut 28 must be completely loosen such that the upper portion thereof is closely attached to the lower surface of the lower cover 6. The reason is that, when the nut 28 is not fully loosened, the packing tube 26 is radially expanded, causing the diameter of the expanded tube to be large than that of the mouth of the barrel 39. As a result, the tube is not inserted into the mouth.

Accordingly, when the fastening nut 28 is fully loosened, the packing tube 26 and the air injecting pipe 15 having the separate preventing cap 27 can be easily inserted into the mouth of the barrel 39 so that the tubular portion 31 of the fastening nut 28 mounted on the periphery of the air injecting pipe 15 leaves a predetermined distance from the mouth of the barrel and wraps the outer periphery of the neck thereof.

In this condition, when the nut 28 is fastened, the packing tube 26 is radially expanded so as to seal the mouth of the barrel.

Explaining in detail this process, first, when the nut 28 rotates while gripping the pump in one hand, while the tubular portion 31 of the nut 28 is in the other hand, the nut 28 descents along the longitudinal direction of the air injecting pipe 15.

At this time, in case of the fully loosened nut 28, the nut 28 has a regular clearance angle that the nut 28 can be unloaded and rotate until the lower surface of the screw portion 30 in the nut 28 is contacted to the contacting surface of the sliding plate 29.

Therefore, in installing the pump 1, users can exactly recognize the start point of the expansion of the packing tube 26, thereby controlling the fastening force of the nut.

On the contrary, when the nut 28 further rotates in case of contacting the lower surface of the screw portion 30 with the sliding plate 29, the nut 28 cannot descend by engaging to the upper end of the mouth of the barrel 39 and may be idled, while the air injecting pipe 12 engaged with the nut 28 is lifted up.

That is, when the nut 28 idles, the force being pressed by the lower surface of the screw portion 30 is subjected to the packing tube 26 disposed to the outer periphery of the air injecting pipe 15 between the sliding plate 29 and the separate preventing pipe 29, which is longitudinally compressed and radially expanded.

As a result, the radially expanded tube 28 can seal the mouth of the barrel 39, securely fixing the pump 1 to the mouth of the barrel 39.

According to the invention, the air injecting pipe 15 is provided with an unthreaded area between the screw threads formed on the upper and lower portions thereof to idle the fastening nut 28, when the fasten nut 28 descends past the upper screw thread, thereby preventing the separation of the packing tube 26 from excessively expanding thereof.

Therefore, the packing tube is properly expanded by fastening the nut 28 at user's option so that the pump 1 is fixed to the mouth of the barrel 39 and the mouth thereof is sealed.

The operation of the inventive air pump is as follows:

When the head 7 is pressed by user in order to drink the natural mineral water, the bellows 3 and the spiral spring incorporated therein are compressed.

At this time, as the guide groove 18 formed on the flange 17 corresponds to the guide piece 10 formed along the axial direction of an inner periphery of the upper cover 5, the head 7 performs a rectilinear motion along the guide piece 10 of the upper cover 5 without swinging.

Accordingly, in case of compressing the bellows 3, as a suction valve **20*a* of the center of the operation plate 21 is closed by the air in the bellows 3 and an exhaust valve 20*b* of the lower cover 6 is opened, the air in the bellows 3 is discharged through the opened exhausted valve 20*b* into the air injecting pipe 15 and is introduced to the barrel 39. Therefore, the air pressure in the barrel 39** becomes a greater than the atmosphere pressure.

Thus, the water in the barrel 39, in high pressure, is discharged to the exterior of the barrel 39, in low pressure, so the user can drink the water.

The content of the discharged water is proportioned to the difference between the air pressure in the barrel 39 and the atmosphere pressure, this proportion is proportioned to the combination the magnitude of force pressing the head 7 with the decanting distance of the pressed head 7, user can adjust the amount of the water by properly combining the above factors.

On the other hand, when the pressing force is removed from the head 7, the water is not discharged. The result is that the bellows 3 is expanded by the restoring force of the spiral spring 19 so as to cause the suction force in the bellows 3, thereby introducing the air in the barrel 39 into the bellows 3.

That is, the air in the barrel is exhausted through the through-hole formed on the edge of the exhaust valve **20*b* to thereby to decrease the air pressure in the barrel 39, reducing the pressure difference between the interior and the exterior of the barrel 39**.

Further, when the bellows 3 lifts up by the restoring force of the spring 19, the flange 17 formed on the lower periphery of the head 7 is hooked to the annular flange 9 of the upper end of the upper cover 5, preventing them from separating each other.

The air pump in accordance with a preferred embodiment of the invention is provide with the effect as follows:

First, the inventive air pump can stand up in the barrel, providing with the convenience of installation and a sense of security since it can be considered stable by its users and reducing the installing space.

Second, the sealing device in accordance with the invention performs the seal operation by means of expanding the packing tube 26 made of a silicon resin having a soft and elastic material, so the variation of the sealing member is large.

That is, the fact is that the packing tube 26 has a soft and a large variation means that the attaching force to the inner periphery of the mouth of the barrel 39 becomes large, thereby increasing a sealing efficiency. As a result, the inventive sealing device can improve a seal maintaining capacity of an air pump and a locking capacity to the barrel.

Third, as the plug member 44 is disposed to a side of the guide pipe 43 connected to the drain pipe 16 to thereby seal the entrance of the guide pipe 43. The entrance of the guide pipe 43 is covered by the plug member 44, preventing contaminations such as dust or vermin from entering the guide pipe as well as maintaining the freshness of water for a long time.

Furthermore, even if a user pressed involuntarily the head 7 of the pump 1, the discharge of the water is prevented unless the pressing force can open the plug member 44, preventing spilling due to the undesired discharge of water.

Figure 6A:
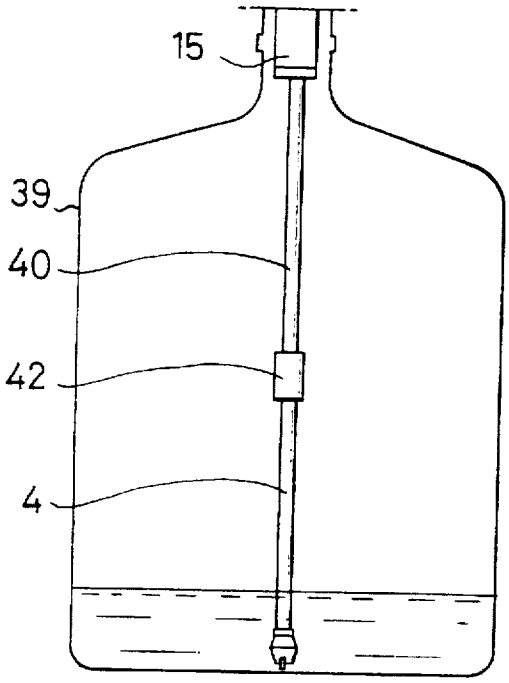
FIG. 6A is a front view in which the suction pipe of the air pump of the present invention is installed in a barrel whose whole length is relatively long.
Figure 6B:
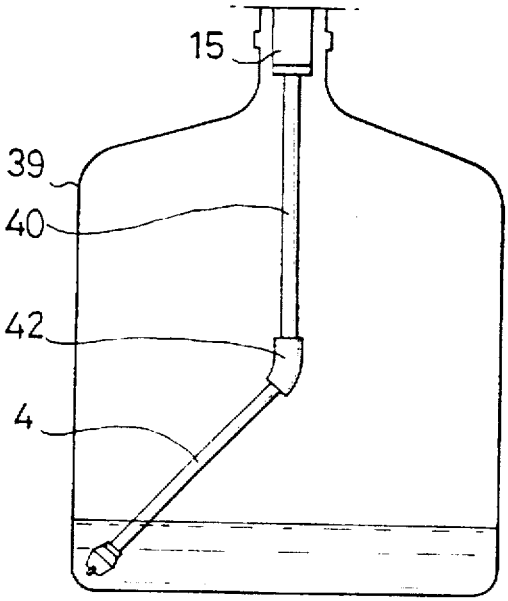
FIG. 6B is a front view in which the suction tube of the air pump of the present invention is installed in a barrel whose whole length is relatively short.

Fourth, as the connecting member 42 has a flexibility and a elasticity and is disposed to the connecting portion between the suction pipe 40 connected to the drain pipe 16 of the lower cover 6 and the extension pipe 41 connected to the suction pipe 40, as shown in FIG. 6A, in case of which the entire length of the barrel is long, the suction pipe 40 and the extension pipe 41 are disposed to each other in a straight line, reaching to the bottom of the barrel 39, while as shown in FIG. 6B, in case of which the entire length of the barrel is short, the extension pipe 41 is inclined by the bending of the connecting member 42, reaching the bottom of the barrel.

In other words, when the depth of the barrel is deep, the extension pipe 41 is maintained in a straight line by the elasticity of the connecting member 42.

When the depth of the barrel is shallow, the extension pipe 41 is positioned in the bottom of the barrel by the bending of the connecting member 42.

Accordingly, the inventive pump can remove the inconvenience due to the change of the extension pipe having a proper size every time the entire length of the barrel is different.

As described above, the inventive air pump 1 can lift up the water of the barrel to thereby prevent the water from remaining in the bottom regardless of the entire length of the barrel.

Further, the invention provides a convenience that the content of the water can be freely adjusted at user's option for use.

Although the invention has been shown and described with respect to the preferred embodiments, it will be understood by those skilled in the art that certain changes and modifications may be made without departing from the spirit and scope of the invention as defined in the following claims.

What is claimed is:

1. An air pump for a natural mineral water barrel comprising:

a cover member comprising an upper cover including a through-hole whose radius center is eccentrically positioned from a radius center of a cylindrical body, an annular flange being extended downward on the inner periphery of said through-hole, a guide piece being formed lengthwise from said upper cover on one side of the inner periphery thereof, and fixed protrusions being formed at a predetermined interval along the circumference of said upper cover in the lower portion thereof, a lower cover including fixed holes formed in the outer periphery of the upper portion thereof so as to correspond to the fixed protrusion, a circular boss projected downward from the lower center of the lower cover by a predetermined distance, an air injecting pipe having threaded portions with a predetermined length, respectively, in the upper and lower of the outer periphery thereof and projected from the lower center of the circular boss, and a drain pipe formed within the air injecting pipe at a predetermined interval from the inner periphery of the air injecting pipe and passed through and extended from a side wall of the outer periphery of the lower cover, a head having a circular shaped flange formed in the lower outer periphery thereof and formed eccentrically from the center thereof, said head being inside of an upper cover so as to be inserted into or projected from the inside of the upper cover;

a bellows including an upper boss disposed to the upper center portion thereof which is provided with a pressure spring and a lower boss disposed to the lower center portion thereof, the upper and lower bosses corresponding to a mounting groove of an operation plate having a suction valve and a mounting groove formed in the center portion of the lower cover, respectively; and a sealing means including a packing tube inserted through the outer periphery of the air injecting pipe, said air injecting pipe being joined with a seperation preventing cap at a lower portion thereof, and a pressing means for pressing the packing tube so as to be expanded radially, whereby the packing tube makes a tight contact with a periphery of a neck of the barrel for sealing the barrel from outside.

2. The air pump of claim 1, further comprising a suction pipe connected to the drain pipe of the lower cover, an extension pipe connected to the suction pipe, and a connecting member having a flexibility and a elasticity and disposed to the connecting portion between the suction pipe and the extension pipe so as to allow the extension pipe to come utmost close to the bottom of the barrel regardless of the entire length of the barrel.

3. The air pump of claim 1, further comprising a banded guide pipe connected to the drain pipe so as to guide the discharge of the water, and a plug member disposed on the guide pipe so as to be able to cover the entrance of the guide pipe except when dispensing water.

4. The air pump of claim 1, wherein the flange of the head is provided with a guide groove on the outer periphery thereof, thereby corresponding to the guide piece on the inner periphery of the upper cover and guiding the axial rectilinear motion of the head.

5. The air pump of claim 1, wherein the screw thread of the threaded portions of the air injecting pipe has a trapezium sectional shape.

6. The air pump of claim 1, wherein the screw thread of the threaded portions of the air injecting pipe has a trapezoid sectional shape.

7. The air pump of claim 1, wherein the separation preventing cap is provided with a circular protrusion on the both sides thereof, the protrusion having a screw fastening hole for improving the engaging force between the air injecting pipe and the cap.

8. The air pump of claim 1, wherein the separation preventing cap is provided with a locking protrusion on the both sides thereof so as to allow the cap to be easily loosened.

9. The air pump of claim 1 wherein the air injecting pipe is provided with a screw thread unforming area between the screw threads formed on the upper and lower portions thereof to idle the fastening nut when the fastening nut is lifted down past the upper screw thread, thereby preventing the packing tube from excessively expanding.

10. The air pump of claim 1, wherein the pressing means includes a first threaded portion formed on the periphery of the air injecting pipe, and a second threaded portion formed on an inner periphery of a fastening nut for engagement with the first threaded portion, whereby rotation of the fastening nut forces the air injecting pump to move in an selected axial direction to compress the packing tube.

11. The air pump of claim 10, wherein the connecting member is made of silicone resin.

12. The air pump of claim 10 wherein the air injecting pipe is provided with a screw thread unforming area between the screw threads formed on the upper and lower portions thereof to idle the fastening nut when the fastening nut is lifted down past the upper screw thread, thereby preventing the packing tube from excessively expanding.

13. The air pump of claim 10, further comprising a sliding plate mounted into the bottom surface of the second threaded portion of the fastening nut so as to prevent a friction therebetween.

14. The air pump of claim 13, wherein the upper surface of the sliding plate is provided with a plurality of annular sliding protrusions so as to reduce the friction between the bottom surface of the second threaded portion of the fastening nut and the sliding plate.

15. The air pump of claim 10, wherein the fastening nut is provided with a plurality of grip grooves on the outer periphery of the tubular portion thereof so as to allow users to easily tighten and loosen the fastened nut.

16. The air pump of claim 15, wherein the plug member has a cap shape.

17. The air pump of claim 15, wherein the plug member has a wedge shape.

* * * * *